US005655400A

United States Patent [19]

Spiegelberg et al.

[11] Patent Number: 5,655,400

[45] Date of Patent: Aug. 12, 1997

[54] PROGRESSIVE DIE APPARATUS AND METHOD FOR MAKING A LEAD ALLOY BATTERY TERMINAL

[75] Inventors: Bernard N. Spiegelberg, Germantown; Dennis J. Brown, Whitefish Bay, both of Wis.

[73] Assignee: Tulip Corporation, Milwaukee, Wis.

[21] Appl. No.: 460,652

[22] Filed: Jun. 2, 1995

[51] Int. Cl.[6] ..... B21D 28/32; B21D 43/05

[52] U.S. Cl. ..... 72/334; 72/356; 72/405.12

[58] Field of Search ..... 72/334, 333, 356, 72/357, 405.11–405.16

[56] References Cited

U.S. PATENT DOCUMENTS

| | | | |
|---|---|---|---|
| 1,338,462 | 4/1920 | Rydbeck | 72/354.2 |
| 1,668,996 | 5/1928 | Anderson . | |
| 1,766,098 | 6/1930 | Booth | 72/354.2 |
| 1,994,178 | 3/1935 | Raiche . | |
| 2,372,011 | 3/1945 | Remington | 72/356 |
| 2,392,175 | 1/1946 | Norton . | |
| 2,526,489 | 10/1950 | Liddicoat | 72/344 |
| 2,566,243 | 8/1951 | Nyquist . | |
| 2,966,987 | 1/1961 | Kaul | 72/359 |
| 2,978,932 | 4/1961 | Frueauff | 72/354.2 |
| 3,280,613 | 10/1966 | Schröm | 72/344 |
| 3,834,213 | 9/1974 | Henzler | 72/405.12 |
| 3,965,716 | 6/1976 | Suzuki | 72/356 |
| 4,177,665 | 12/1979 | Schurmann . | |
| 4,197,772 | 4/1980 | Anderson et al. . | |
| 4,416,141 | 11/1983 | Nippert . | |
| 4,423,617 | 1/1984 | Nippert | 72/356 |
| 4,649,731 | 3/1987 | Eisenmann | 72/358 |
| 4,653,305 | 3/1987 | Kanamaru et al. | 72/343 |
| 4,709,574 | 12/1987 | Horn | 72/356 |
| 4,776,197 | 10/1988 | Scott | 72/358 |
| 4,945,749 | 8/1990 | Walker et al. | 72/356 |
| 5,048,590 | 9/1991 | Carter . | |
| 5,296,317 | 3/1994 | Ratte et al. . | |
| 5,349,840 | 9/1994 | Ratte et al. | 72/357 |

FOREIGN PATENT DOCUMENTS

| | | |
|---|---|---|
| 0117213 | 8/1984 | European Pat. Off. . |
| 5-169183 | 7/1993 | Japan . |
| 902969 | 2/1982 | U.S.S.R. . |

*Primary Examiner*—Daniel C. Crane
*Attorney, Agent, or Firm*—Foley & Lardner

[57] ABSTRACT

A method and apparatus utilizing a single progressive die to cold form a finished lead battery terminal from a lead slug. The apparatus includes a lead pickup station, a progressive die having three stations, a drop off station and a transfer mechanism. The transfer mechanism indexes the lead slug from each station to the next with each cycle of the progressive die.

20 Claims, 2 Drawing Sheets

PROGRESSIVE DIE APPARATUS AND METHOD FOR MAKING A LEAD ALLOY BATTERY TERMINAL

BACKGROUND OF THE INVENTION

This invention relates generally to an apparatus and method for the automated cold forming of lead battery terminals.

In general, battery terminals are utilized as an interface between a sealed battery container and an external device seeking electrical power. Battery terminals are typically formed from lead in a cold or hot forming process. In a hot forming process a lead alloy is heated until it is in a molten state. The molten lead is then poured into a mold or casting and formed into a semi-finished or finished battery terminal. In the cold forming process a lead slug typically at room temperature is subjected to a number of pressing, punching and machining operations in order to create a finished battery terminal.

The hot forming process requires that the lead be heated until it reaches the molten state and then subsequently poured into a mold until it cools. A disadvantage of this method is that it requires the melting of a lead alloy to form the battery terminal. The use of melting for forming terminals may create undesirable porosity and is expensive to implement in an environmentally safe manner.

Existing methods of cold forming a battery terminal from a lead slug require a number of individual steps. In one method a lead slug is first modified in a preform station and then subsequently formed into a finished battery terminal in a final forming press having a split die. Alternatively, in a second method a lead slug is formed into a semi-finished battery terminal in a first station having a split die and then subsequently machined to create a finished battery terminal.

These methods of cold forming a battery terminal require at least two distinct stations in which a lead slug is worked. One of the stations being a press having a split die, and the second station requiring either a separate press for the pre-forming of the slug or a separate machining station for a finishing operation.

Consequently, it would be desirable to have a battery terminal cold formed from a lead slug utilizing a single press.

SUMMARY OF THE INVENTION

The present invention features a method and apparatus for cold forming a battery terminal from a lead slug. An embodiment of the apparatus for forming a finished battery terminal includes a station configured to form a cylindrical lead slug having a lead slug pickup station; a transfer mechanism; and a progressive die. The progressive die is provided with three stations: a preform station configured to form a pre-formed lead slug, a semi-finish station configured to form a semi-finished battery terminal, and a punching station configured to form a finished battery terminal.

An embodiment of the method for manufacturing lead battery terminals in an automated process includes stamping a lead slug in a preform station of a progressive die forming a pre-formed lead slug. A transfer mechanism transfers the pre-formed lead slug to a semi-finish station in the progressive die. The pre-formed lead slug is then stamped in the semi-finish station forming a semi-finished battery terminal. The transfer mechanism then transfers the semi-finished battery terminal to a punching station in the progressive die. Finally the semi-finished battery terminal is punched forming a finished battery terminal having a through hole.

DETAILED DESCRIPTION OF THE PREFERRED EMBODIMENT

Figure 1:
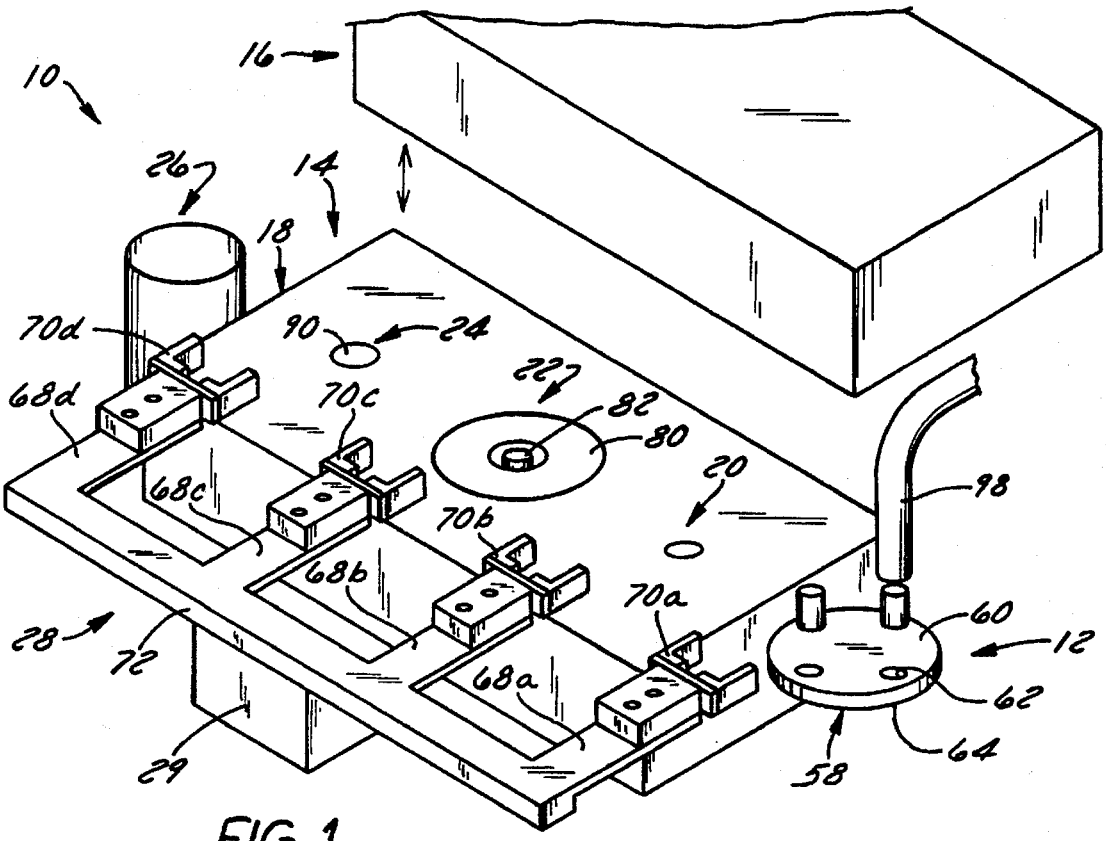
FIG. 1 is a schematic illustration of the lead slug pickup station, progressive die stations, drop station and transfer mechanism.

Referring to FIG. 1, an automated battery terminal forming apparatus 10 includes a lead slug station 12, a press structure and system (not shown) which includes a progressive die 14 having an upper die assembly 16 and a lower die assembly 18. Progressive die 14 includes three stations: a preform station 20, a semi-finish station 22 and a punching station 24. The automated battery terminal forming apparatus 10 further includes a drop station 26 and a transfer mechanism 28.

Apparatus 10 automatically creates a finished battery terminal 30*d* from a lead slug 30*a*. Transfer mechanism 28 simultaneously indexes lead slugs 30*a* from one station to the next with each cycle of progressive die 14. In preform station 20 lead slug 30*a* is formed into a pre-formed lead slug 30*b* including a lead slug cavity 38. Next, in semi-finish station 22 pre-formed lead slug 30*b* is formed into a semi-finished battery terminal 30*c* including a head 44 having at least one annular ring 46, a frustum 50 having a frusto-conical shape, and a splined ring 48 therebetween. Additionally, semi-finished battery terminal 30*c* includes a tapered recess 52 having a blank wall 54. Finally, in punching station 24 semi-finished battery terminal 30*c* is formed into a finished battery terminal 30*d* having a through hole defined by a continuous tapered recess 84.

The apparatus 10 will now be described in greater detail. Referring to FIG. 1, Lead slug station 12 includes a transfer mechanism (e.g. guide tube) to transfer lead slug 30*a* to an indexing turntable 58. Indexing turntable 58 includes a circular index plate 60 having a plurality of truncated openings 62. Openings 62 are truncated by a base 64.

Referring to FIG. 1, transfer mechanism 28 includes four transfer arms 68*a*, 68*b*, 68*c* and 68*d* which extend from base member 72. Transfer arms 68*a*, 68*b*, 68*c* and 68*d* are respectively provided with grippers 70*a*, 70*b*, 70*c*, and 70*d*. After each cycle of progressive die 14, transfer mechanism 28 simultaneously activates transfer arms 68*a*, 68*b*, 68*c* and 68*d*. Transfer mechanism 28 is cyclically moved with the opening and closing of upper and lower die assemblies 16 and 18 by an appropriate motion controller 29 (e.g. electronically controlled stepping motor, pneumatic or hydraulic drive). In this manner with each cycle of progressive die 14 arm 68*a* and gripper 70*a* transfer lead slug 30*a* from lead slug station 12 to preform station 20, arm 68*b* and gripper 70*b* transfer pre-formed lead slug 30*b* from preform station 20 to semi-finish station 22, arm 68*c* and gripper 70*c* transfer semi-finished lead slug 30*c* from semi-finish station 22 to punching station 24, and arm 68*d* and gripper 70*d* transfer finished battery terminal 30*d* from punching station 24 to drop station 26. Additionally, arm 68*c* and gripper 70*c* include means to rotate semi-finished lead slug 30*c* 180 degrees as semi-finished lead slug 30*c* is transferred to punching station 24.

As shown schematically in FIG. 1, preform station 20 includes a preform station cavity located in upper die assembly 16. The preform station cavity includes a preform opening having a diameter which is greater than the outer diameter D1 of lead slug 30*a*. Additionally, preform station cavity terminates at a preform station cavity end. Preform station 20 further includes a preform punch (not shown) located in lower die assembly 18 in alignment with the preform opening in upper die assembly 16. The preform punch has a diameter less than the diameter of the preform opening. When the upper and lower die assemblies 16, 18 are activated the preform punch is extended beyond the surface of upper die assembly 16 into preform station cavity forming a pre-formed battery terminal 30*b* having lead slug cavity 38.

Figure 3A:
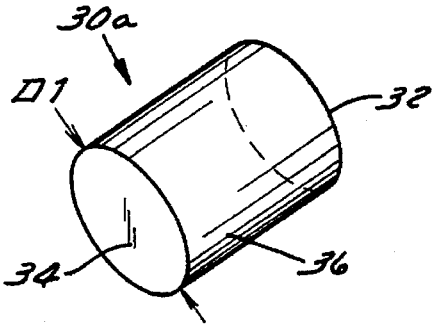
FIG. 3*a* is an isometric illustration of a lead slug.
Figure 3B:
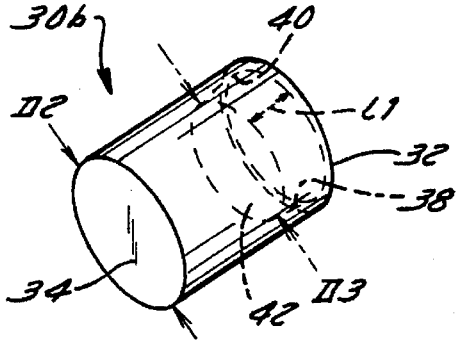
FIG. 3*b* is an isometric illustration of a pre-formed lead slug.
Figure 3C:
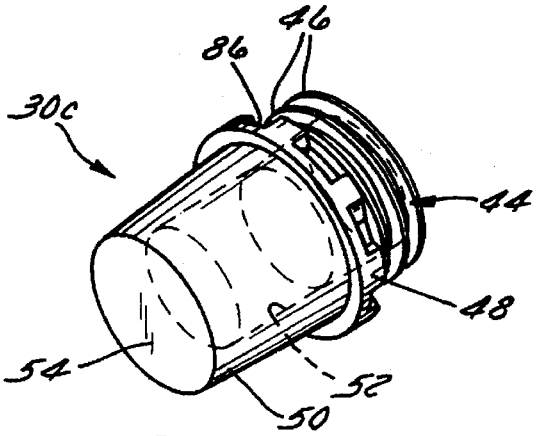
FIG. 3*c* is an isometric illustration of a semi-finished battery terminal.
Figure 3D:
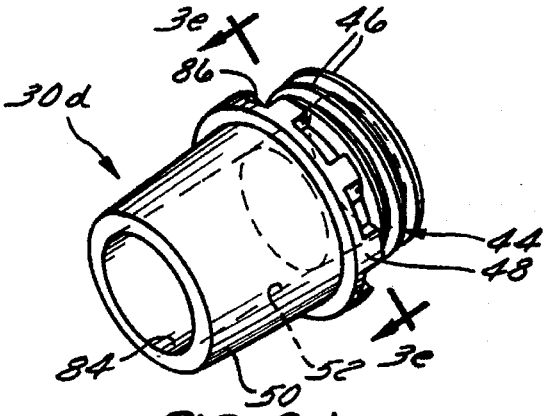
FIG. 3*d* is an isometric illustration of a finished battery terminal.
Figure 3E:
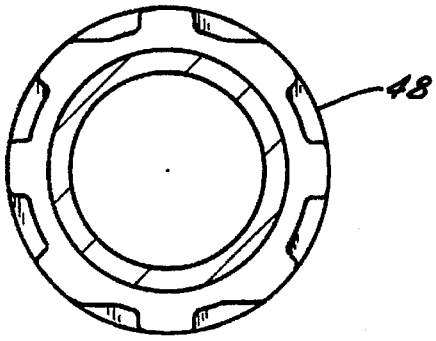
FIG. 3*e* is a cross-sectional view of the splined ring of a finished battery terminal.

As shown schematically in FIG. 1, the second station in progressive die 14 is semi-finish station 22 including a split die 80 and a forming punch 82 located in lower die assembly 18. In the preferred embodiment split die 80 comprises two sections. However, split die 80 may contain other numbers of multiple sections (e.g. four) as well. When closed the outer surface of split die 80 has a truncated conical surface which is slidable against an associated surface in lower die assembly 18. The lower portion of split die 80 includes an inner profile configured to produce head 44 and annular rings 46 of semi-finished battery terminal 30*c* (FIG. 3*c*). The upper portion of split die 80 includes an inner profile configured to form a plurality of splined ring recesses 86 of semi-finished battery terminal 30*c* splined ring 48. In the preferred embodiment semi-finished battery terminal 30*c* includes eight recesses 86. In order to permit split die 80 to release semi-finished battery terminal 30*c* four of the eight recesses have a wall with an angle sufficient to allowing separation of the split die (FIG. 3*e*). Semi-finish station 22 further includes a forming cavity located in upper die assembly 16 in alignment with forming punch 82. The forming cavity in upper die assembly 16 has an upper tapered region configured to form frustum 50 of semi-finished battery terminal 30*c*, and a lower portion configured to form an upper region of splined ring 48 of semi-finished battery terminal 30*c*.

Figure 2:
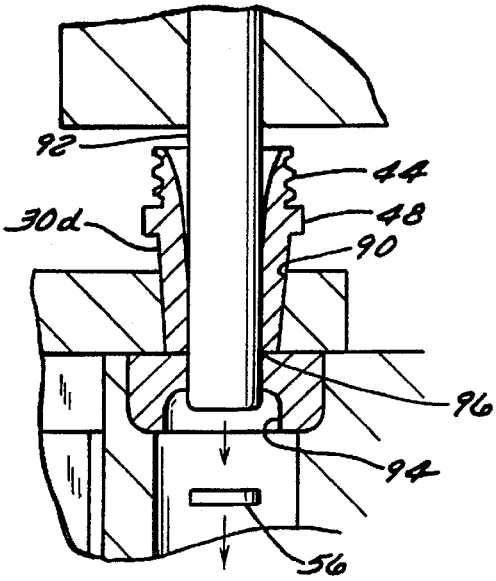
FIG. 2 is a cross-sectional view of the punching station.

Referring to FIG. 2, the third station in progressive die 14 is punching station 24 which includes a punching station opening 90 located in lower die assembly 18 and a through punch 92 located in upper die assembly 16. Lower die assembly 18 further includes an anvil 94 having an anvil aperture 96. Anvil 94 is located below opening 90.

The method of creating a finished battery terminal utilizing apparatus 10 as described above will now be described in greater detail. In lead slug station 12 an elongated cylindrical lead slug 30*a* is formed (e.g. cut or sheared) from an extruded lead wire 98. Lead slug 30*a* includes a proximal end 32, a distal end 34, an outer diameter D1, and an outer surface 36 (FIG. 3*a*). Lead slugs 30*a* are transferred from lead slug station 12 by means of a transfer mechanism (e.g. guide tube) to circular index plate 60. Lead slug 30*a* is received in opening 62 and proximal end 32 of lead slugs 30*a* is supported by base 64. Indexing turntable 58 is rotatably indexed to permit lead slug 30*a* to be removed by transfer mechanism 28.

Transfer mechanism 28 transfers lead slug 30*a* from lead slug station 12 to preform station 20 and places lead slug proximal end 32 in contact with lower die assembly 18 below the preform opening. When progressive die 14 is activated the preform punch creates a cavity 38 in lead slug 30*a* extending from proximal end 32 toward distal end 34. In this manner lead slug 30*a* is formed into preform slug 30*b* (FIG. 3*b*) including an outer diameter D2 and a cavity 38 having a cavity wall 40 and a cavity base 42. Cavity 38 has a diameter D3 and a depth L1. In addition outer surface 36 is refined such that diameter D2 of preformed slug 30*b* is the same as the diameter of the preform cavity located in upper die assembly 16.

Transfer mechanism 28 transfers pre-formed lead slug 30*b* from preform station 20 to semi-finish station 22 with arm 70*b* and gripper 68*b*. Pre-formed lead slug 30*b* is transferred to semi-finish station 22 and situated such that proximal end 32 having cavity 38 is in contact with lower die assembly 18, and distal end 34 is orientated toward upper die assembly 16.

When progressive die 14 is activated, upper die assembly 16 and lower die assembly 18 come together, subsequently forming punch 82 is activated extending from lower die assembly 18 into upper die assembly 16 within the forming cavity. In this manner a semi-finished battery terminal 30*c* is formed including frustum 50, splined ring 48 having recesses 86, and head 44 having annular rings 46 (FIG. 3*c*). Additionally semi-finished battery terminal 30*c* includes a tapered recess 52 extending from proximal end 32 toward distal end 34 and concluding at a blank wall 54.

After upper die assembly 16 and lower die assembly 18 are separated, split die 80 is raised up and outward along the associated surface in lower die assembly 18. In this manner split die 80 separates and semi-finished battery terminal 30*c* is freed from split die 80 and is in a position to be transferred by transfer mechanism 28.

Transfer mechanism 28 transfers semi-finished battery terminal 30*c* from semi-finish station 22 to punch station 24 with arm 70*c* and gripper 68*c*. Semi-finished battery terminal 30*c* is rotated 180 degrees by gripper 68*c* from semi-finish station 22 to punching station 24. In this manner distal end 34 is positioned in lower die assembly 18 and proximal end 32 is orientated toward upper die assembly 16. When progressive die 14 is activated through punch 92 extends from upper die assembly 16 into lower die assembly 18 thereby removing a disc 56 from semi-finished battery terminal 30*c* forming continuous tapered recess 84 from proximal end 32 to distal end 34. In this manner finished battery terminal 30*d* is formed (FIG. 3*d*).

Transfer mechanism 28 subsequently transfers finished battery terminal 30*d* to drop station 26 with arm 68*d* and gripper 70*d*.

In an alternative embodiment, progressive die 14 includes only two stations, a semi-finish station 22 and a punching station 24. In this embodiment, lead slug 30*a* is transferred directly to semi-finish station 22.

Although the invention has been described in conjunction with specific embodiments thereof, it is evident that alternatives, modifications and variations will be apparent to those skilled in the art. For example in the preferred embodiment the transfer mechanism 28 may comprise up to four separate devices. In addition, lead slug station 12 may include an in line indexing device in place of a circular index plate 60. It is intended that the claims embrace these and other alternatives, modifications and variations which fall within the spirit and scope of the appended claims.

We claim:

1. A method for manufacturing lead battery terminals in an automated process using a progressive die having at least three stations, the method comprising the steps of:

stamping a lead slug in a preform station of a progressive die forming a pre-formed lead slug having a cavity;

transferring the pre-formed lead slug with a transfer mechanism to a semi-finish station in the progressive die;

stamping the pre-formed lead slug in the semi-finish station forming a semi-finished battery terminal including a head having at least one ring, a frustum, a splined ring formed therebetween, and a tapered recess having a blank wall;

transferring the semi-finished battery terminal to a punching station in the progressive die; and punching the semi-finished battery terminal in the punching station to punch a disc from the blank wall forming a finished battery terminal having a through hole.

2. The method of claim 1, including the step of transferring the lead slug to a rotatably indexing turn table.

3. The method of claim 1 including the step of simultaneously forming the pre-formed lead slug, semi-finished battery terminal and finished battery terminal.

4. The method of claim 1, including the step of positioning the pre-formed lead slug onto a split die in the semi-finish station with the cavity adjacent to the lower die.

5. The method of claim 1, including the step of axially driving a through punch from the upper die in the punching station through the semi-finished battery terminal creating a through hole.

6. The method of claim 1, including the step of transferring the finished battery terminal to a drop station.

7. The method of claim 6, including the step of simultaneously transferring the lead slug, pre-formed lead slug, semi-finished battery terminal and finished battery terminal to the next station.

8. An apparatus for forming a finished battery terminal, the apparatus comprising:

a station configured to form a cylindrical lead slug;

a lead slug pickup station;

a transfer mechanism; and a progressive die having a preform station configured to form a pre-formed lead slug having a cavity, a semi-finish station configured to form a semi-finished battery terminal including a head having at least one ring, a frustum, a splined ring formed therebetween, and a tapered recess having a blank wall, and a punching station configured to punch a disc from the semi-finished battery terminal to form a finished battery terminal.

9. The apparatus of claim 8, wherein the lead slug pickup station comprises a rotatable plate having a plurality of tapered holes to receive the lead slugs.

10. The apparatus of claim 8, wherein the lead slug pickup station comprises a rotatable plate including a plurality of holes having an opening to receive the lead slug and a bottom to support the lead slug.

11. The apparatus of claim 8, wherein the transfer mechanism comprises a 3 axis transfer mechanism including four arms and four grippers.

12. The apparatus of claim 8, wherein the progressive die comprises a lower die set and an upper die set having 3 stations.

13. The apparatus of claim 12, wherein the preform station includes a preform punch.

14. The apparatus of claim 12, wherein the semi-finish station includes a split die and a forming punch in the lower die.

15. The apparatus of claim 12, wherein the punching station includes a through punch in the upper die.

16. A method for manufacturing lead battery terminals in an automated process using a progressive die having at least two stations, the method comprising the steps of:

transferring a lead slug to a semi-finish station in a progressive die;

stamping the lead slug in the semi-finish station forming a semi-finished battery terminal including a head having at least one ring, a frustum, a splined ring formed therebetween, and a tapered recess having a blank wall;

transferring the semi-finished battery terminal to a punching station in the progressive die; and punching the semi-finished battery terminal in the punching station to punch a disc from the blank wall forming a finished battery terminal having a through hole.

17. The method of claim 16 including the step of simultaneously forming the semi-finished battery terminal and finished battery terminal.

18. The method of claim 16 including the step of simultaneously transferring the lead slug, semi-finished battery terminal and finished battery terminal to the next station.

19. The method of claim 16, including the step of rotating the semi-finished battery terminal 180 degrees prior to placement in the punching station.

20. The method of claim 16, including the step of axially driving a punch from the upper die in the punching station though the semi-finished battery terminal creating a through hole.

* * * * *